United States Patent [19]

Coperthwaite

[11] 3,972,163

[45] Aug. 3, 1976

[54] CONCENTRIC BUILDING

[76] Inventor: William S. Coperthwaite, Bucks Harbor, Maine 04618

[22] Filed: Oct. 11, 1974

[21] Appl. No.: 514,127

[52] U.S. Cl. ..... 52/82; 52/248; 52/249; 52/237

[51] Int. Cl.[2] ..... E04B 1/32

[58] Field of Search ..... 52/82, 18, 237, 588, 52/90, 248, 249, 73

[56] References Cited

UNITED STATES PATENTS

| | | | |
|---|---|---|---|
| 40,191 | 10/1863 | Shidler | 52/537 |
| 1,474,827 | 11/1923 | Jones | 52/82 |
| 2,499,478 | 3/1950 | Feser | 52/237 |
| 3,214,872 | 11/1965 | Vogelgesang | 52/82 |
| 3,281,999 | 11/1966 | Keely | 52/82 |
| 3,412,518 | 11/1968 | Waite | 52/249 |
| 3,562,974 | 2/1971 | Niemeyer | 52/73 |
| 3,755,975 | 9/1973 | Herzer | 52/90 |
| 3,766,693 | 10/1973 | Richards | 52/82 |
| 3,817,011 | 6/1974 | Weed | 52/588 |
| 3,827,200 | 8/1974 | Preissler | 52/82 |

FOREIGN PATENTS OR APPLICATIONS

| | | | |
|---|---|---|---|
| 1,438,883 | 4/1966 | France | 52/82 |
| 1,581,590 | 9/1969 | France | 52/82 |
| 660,200 | 6/1938 | Germany | 52/237 |
| 644,752 | 9/1962 | Italy | 52/82 |

OTHER PUBLICATIONS

House & Home, Jan. 1958, p. 123.

*Primary Examiner*—Ernest R. Purser
*Assistant Examiner*—Henry Raduazo
*Attorney, Agent, or Firm*—Stanley D. Schwartz

[57] ABSTRACT

A concentric building including a foundation; a first substantially circular platform serving as a lower floor resting upon the foundation; at least one second substantially circular platform smaller in diameter than, and concentric with the first platform, the second platform serving as an upper floor. A plurality of vertically oriented poles are secured between the first and second platforms, and positioned to rigidly hold the second platform above the first platform. A lower wall is attached to the circumference of, and slopes outwardly away from the first platform. At least one upper wall is attached to the circumference of, and slopes outwardly away from the second platform. First and second tension cables are clamped around the uppermost outer perimeters of the lower and upper walls, respectively, for retaining the walls in an upright position. A roof is secured to the top edges of the lower and upper walls, the upper portion of the roof being truncated to provide a skylight. A hatchway is provided in the upper platform as an access means between the lower and upper platforms; and a doorway is provided in the lower wall.

20 Claims, 12 Drawing Figures

CONCENTRIC BUILDING

BACKGROUND OF THE INVENTION

The field of the present invention relates generally to buildings, and more specifically, to concentric buildings.

The nomads of inner Asia are known to have used a portable dwelling structure made of light poles and covered with felt. These nomadic builders are believed to be the first people to use the principle of the tension-band in the support of a dwelling. This advance allowed the roof, or roofwall, of a structure to be raised above the ground without the use of internal poles or trusswork.

The tension-band support technique solved a basic architectural problem of eliminating negative space, such as the space formed by the walls of most tent structures as they meet the ground. Posts and trusswork blocking the interior of the dwelling were eliminated. Nomadic tension-bands were made of the hair of yak, camel or goat, or the wool of sheep, in the form of several ropes sewn side by side. The ropes were encircled around the building at the eaves to counter the outward thrust of the roof.

The tension-band principle has since been used in many applications, including the construction of lightweight containers (buckets, boxes, barrels and baskets), tubs, tankards, silos, and for large masonry domes such as those in the Levant and ancient Rome.

Although the basic tension-band technique has been known in the prior art, it has not been successfully applied to multistory buildings. Modern technology requires the maximum utilization of space within a building consummate with cost. In effect, the problem is to provide a plurality of buildings within a building.

SUMMARY OF THE INVENTION

Accordingly, with the problems of the prior art given above taken into consideration, it is an object of this invention to provide an improved concentric building.

Another object of this invention is to provide a plurality of concentric buildings within a building.

Still another object is to provide a concentric building with improved natural lighting.

A further object of this invention is to provide a concentric building with improved utilization of space, To accomplish the above objects, the concentric building includes a foundation; a lower platform set upon the foundation; an upper platform supported above and concentric with the lower platform; outwardly sloping lower and upper self-supporting walls secured to the perimeters of the lower and upper platforms, respectively; and a roof secured to the top edges of the lower and upper walls. A skylight is provided in the roof, and a plurality of windows are provided.

BRIEF DESCRIPTION OF THE DRAWINGS

The foregoing and other objects, features and advantages of the invention will be apparent from the following detailed description of the invention, as illustrated in the accompanying drawings, wherein like items are designated by the same numeral, in which.

Figure 3:
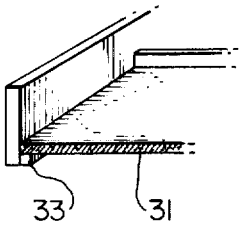
Figure 4:
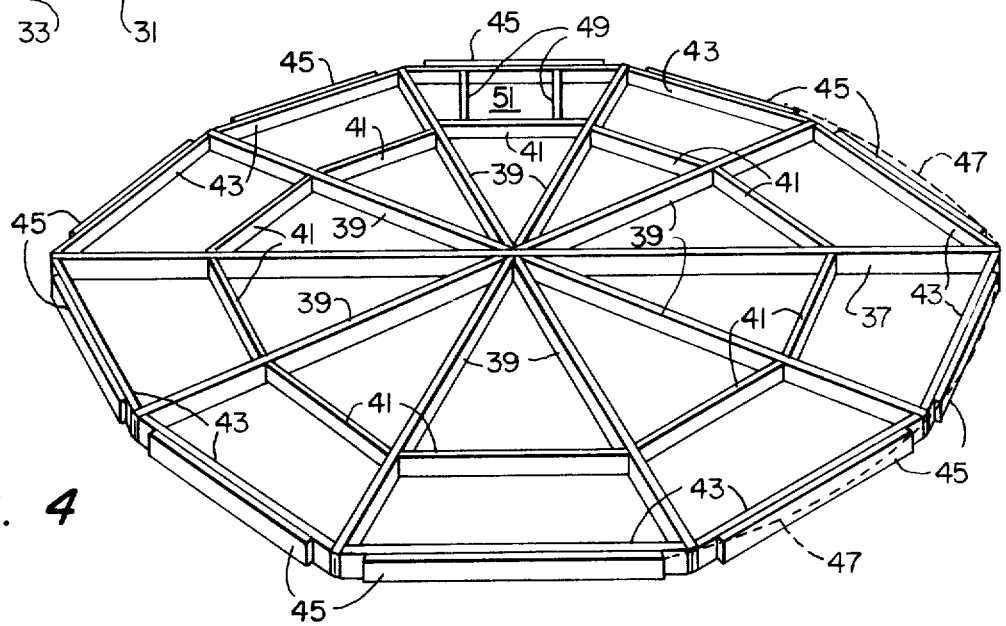
Figure 5:
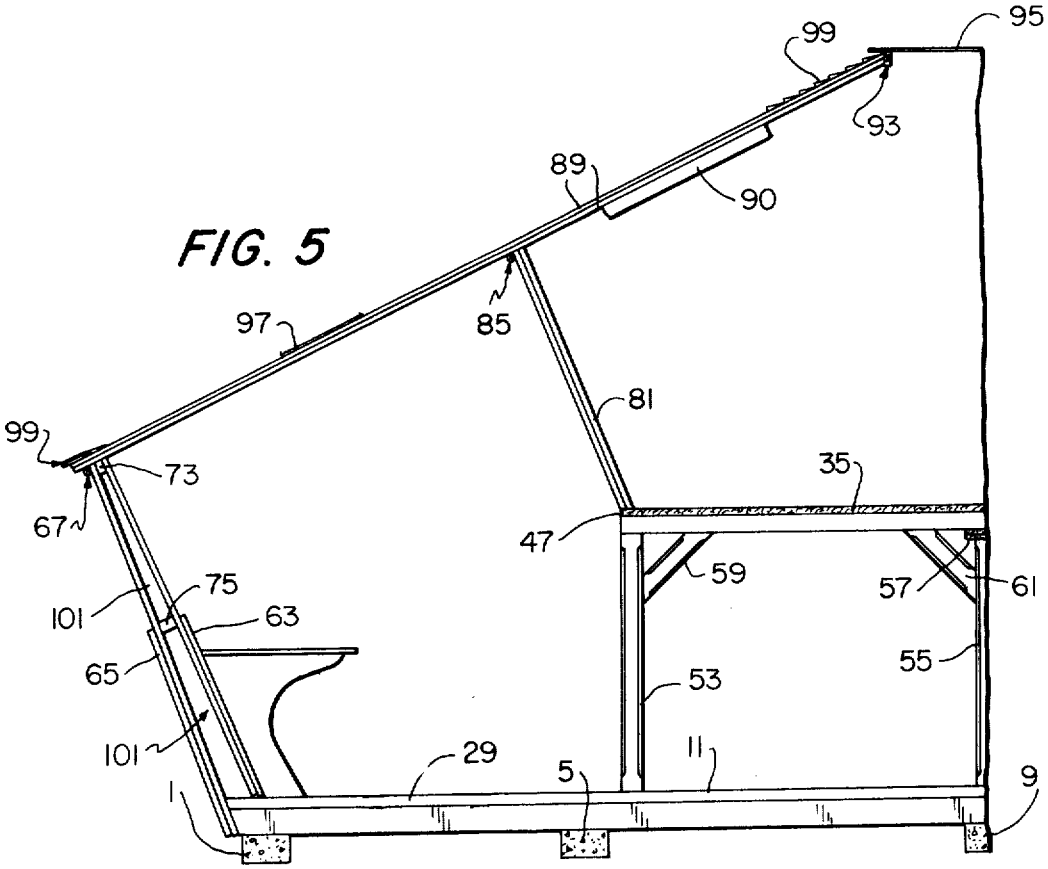
Figure 11:
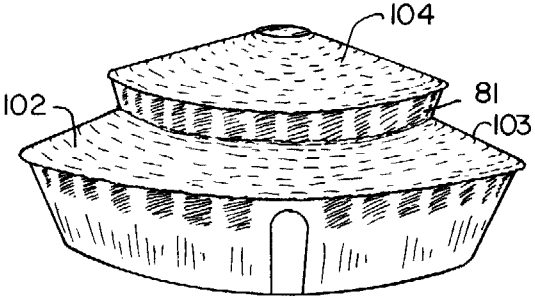
Figure 6:
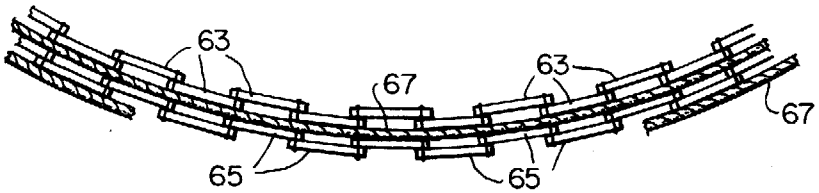
Figure 7:
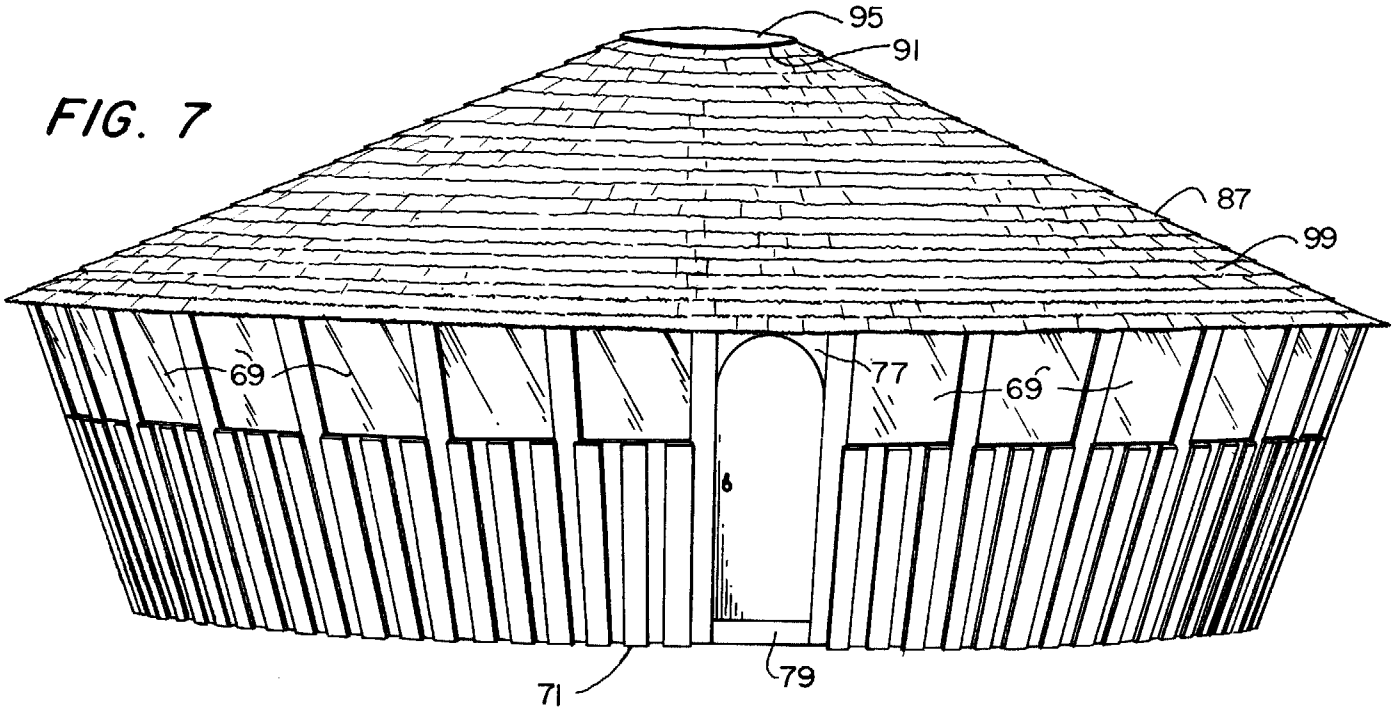
Figure 10:
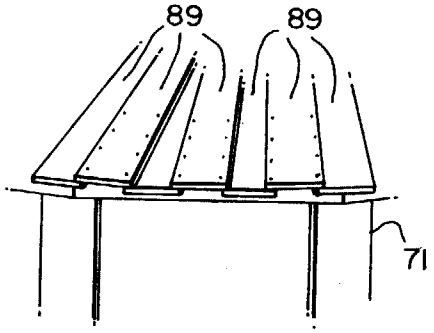
Figure 9:
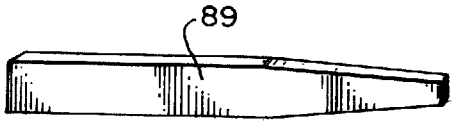
Figure 8:
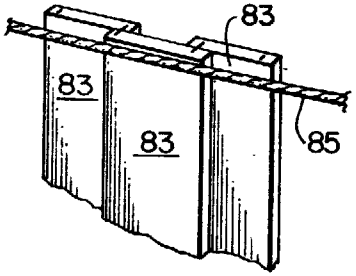

FIIG. 2 is a top view of the framing layout of the lower platform or lower floor of the dwelling;

FIG. 3 is a partial isometric end view of the construction of the bottom of the lower platform;

FIG. 4 is an isometric top view of the framing plan of the upper platform or floor of the dwelling;

FIG. 5 is a one-half sectional view of the concentric dwelling;

FIG. 6 is a top view of the main wall of the dwelling;

FIG. 7 is a frontal isometric view of the dwelling with a conical roof;

FIG. 8 is a partial isometric elevation view of the upper wall of the dwelling with tension cable;

FIG. 9 is an isometric view of a tapered roof board;

FIG. 10 is an isometric end view of the roof construction of the dwelling;

FIG. 11 is a frontal isometric view of the dwelling in clerestory form; and

Figure 12:
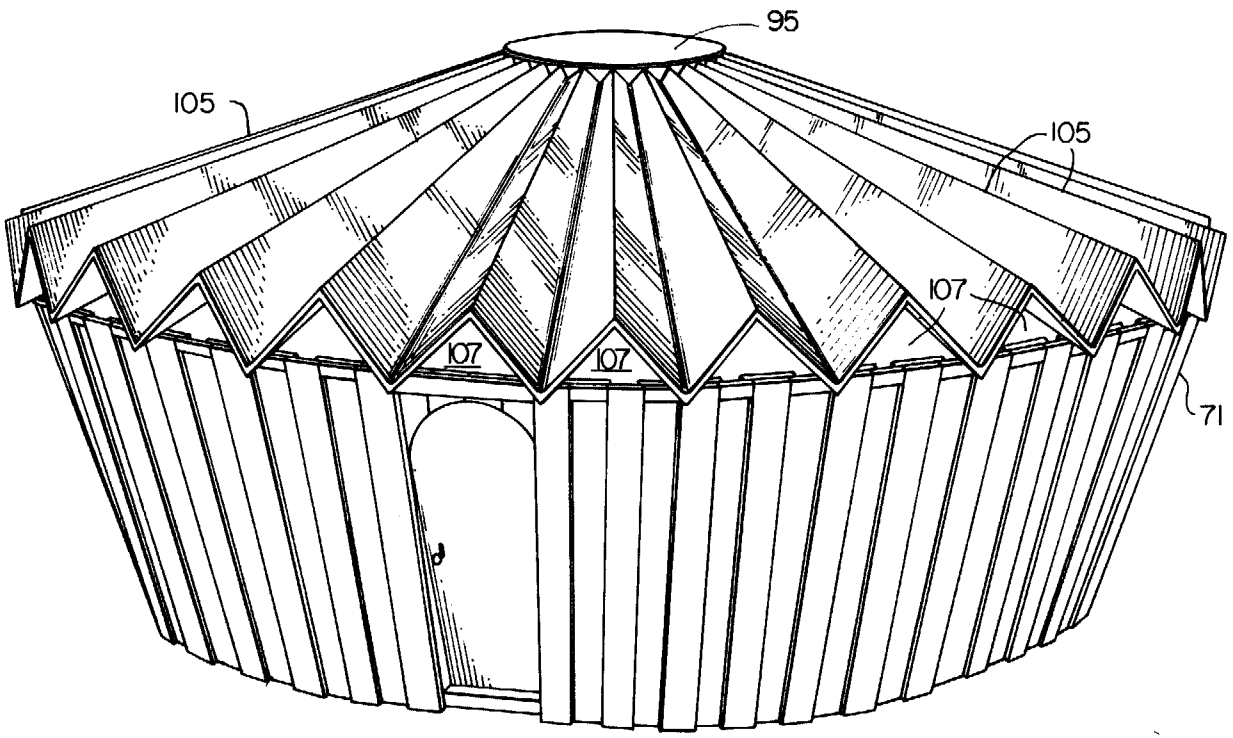

FIG. 12 is a frontal isometric view of the dwelling with a folded plate roof.

DETAILED DESCRIPTION OF THE INVENTION

With reference to the drawings, the concentric building includes a foundation, a lower platform 11 with a main or lower wall 71, an upper platform 35 with an upper wall 81, and roof means.

Figure 1:
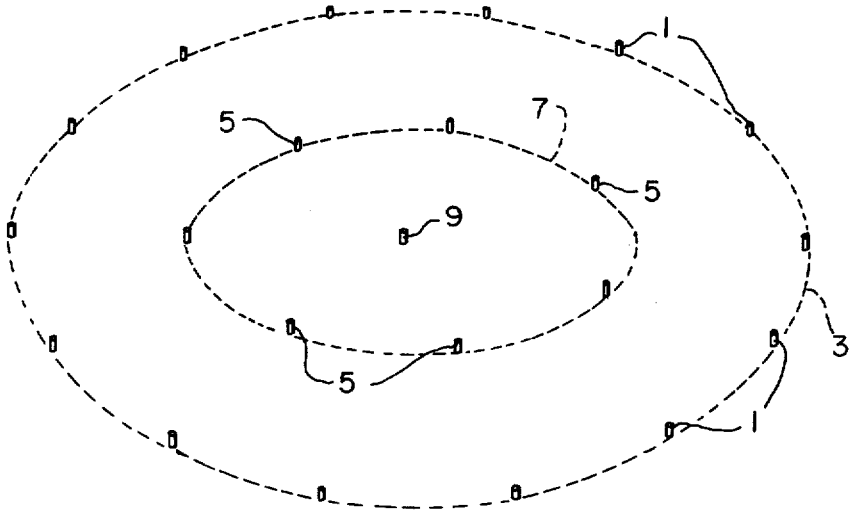
FIG. 1 is an isosmetric top view of the foundation layout for the concentric dwelling.

The foundation, as shown in FIG. 1, includes 14 outer solid footings 1 evenly spaced around the circumference of an outerr circle 3. Seven inner solid footings 5 are evenly spaced around the circumference of an inner circle 7, the inner circle 7 being concentric with the outer circle 3. A single solid footing 9 is located at the center of the concentric circules 3, 7 formed by the plurality of inner and outer footings 1, 5. All of the footings 1, 5, 9 have one end below the frost line and another end protruding above ground so as to provide a level foundation.

Figure 2:
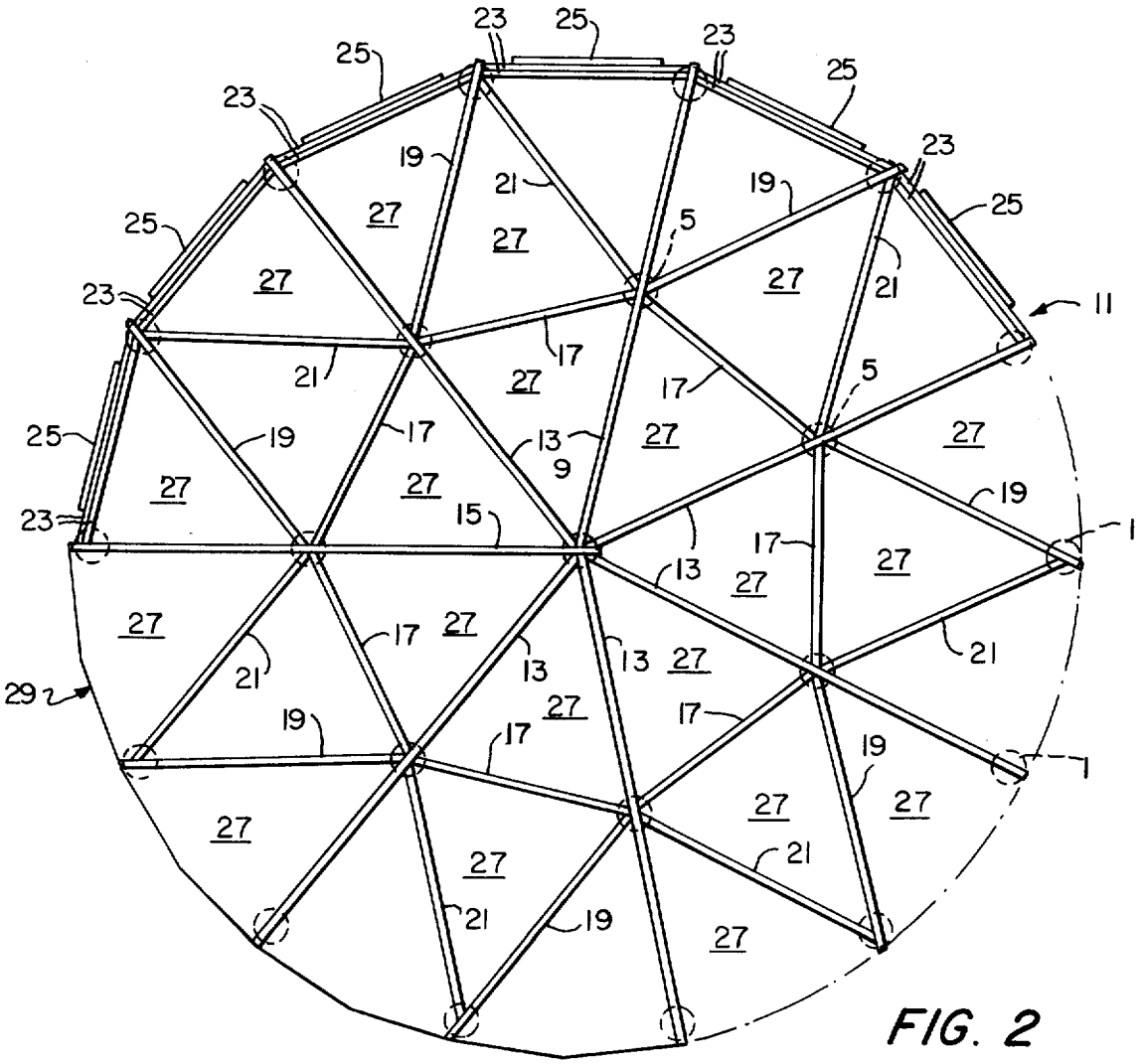

The lower platform 11 of the concentric dwelling is shown in FIG. 2. Included in the platform are six radial timbers 13, and a main radial timber 15 slightly longer than the other six radial timbers 13. The radial timbers 13, 15 are nailed or otherwise joined together at one end on top of the center solid footing 9. The end of the main radial timber 15 is located over a diameter of the center footing 9 and projects slightly beyond the center footing 9, as shown. All of the remaining radial timbers 13 each have one end nailed to the main timber 15. The other ends of the radial timbers 13 and main radial timber 15 are located on top of alternate individual ones of the outer footings 1; whereas the approximate centers of the radial timbers 13 and main radial timber 15 are located upon an individual one of the inner footings 5.

Seven inner ring timbers 17 are located between individual pairs of the inner footings 5. The ends of the ring timbers rest upon their respective inner footings 5, and are nailed to the radial timber 13 or main timber 15 located on the same respective inner footing 5.

Seven timbers 19 are cut to fit from alternate inner footings 5 to the outer footings 1 located between the radial timbers 13 and main timber 15. The ends of the timbers 19 located on the alternate inner footings 5 are nailed to their respective radial timbers 13 and main timber 15. As shown, the other ends of the timbers 19 extend beyond the diameters of their respective outer footings 1.

As shown in FIG. 2, seven other timbers 21 are cut to fit from the other alternate ones of the inner footings 5 to the outer footings 1 upon which the ends of the timbers 19 are resting. The timbers 21 are shorter than the timbers 19. One end of each of the timbers 21 is nailed to its respective radial timber 13 or main timber 15 at the respective inner footing 5, whereas the other end of each of the timbers 21 is nailed to the end of its respective timber 19 located upon a common outer footing 1.

Pairs of outer ring timbers 23 are cut to fit between, and have their ends nailed to, the outer ends of the radial timbers 13 and timbers 19, and the outer ends of the main radial timber 15 and adjacent timbers 19 (see FIG. 2). Floor reinforcement timbers 25, shorter in length than the length of each of the pairs of outer ring timbers 23, are nailed to the outer transverse faces of each one of the outer ring timbers 23.

The timbers 13, 15, 17, 19, 21, 23 of the lower platform 11, as shown in FIG. 2, form a plurality of triangular cells 27. If it is desirable to insulate the flooring 29 from the ground or outside cold, a bottom 31 must be added to each of the triangular cells 27, for retaining an insulation such as vermiculite within each cell 27. As shown in FIG. 3, the bottom 31 of each cell 27 may be cut from material such as plyscore sheeting. One inch by 1 inch strips 33 may be nailed into the bottom of the sides of the timbers of each cell 27 to hold the bottom 31 material in place. The bottom 31 may be nailed into the strips 33 and timbers. The flooring 29 is nailed to and covers the timbers 13, 15, 17, 19, 21, 23, and 25, and provides the lower floor of the dwelling. ¾ inch plywood sheeting or other suitable material may be used for the flooring 29.

The upper platform 35 is shown in FIG. 4 and includes a main timber 37 and eight radial timbers 39. As shown, the eight radial timbers 39 have one end nailed approximately to the center of the main timber 37, four radial timbers 39 being evenly spaced on either side of the main timber 37. Inner bracing timbers 41 are located between and with their ends nailed into the main timber 37 and its adjacent radial timbers 39, and likewise between adjacent radial timbers 39. Outer bracing timbers 43 are located between and nailed to the ends of the main timber 37 and the ends of its adjacent radial timbers, and between the ends of the remaining adjacent radial timbers 39. Upper floor edge reinforcement timbers 45 are nailed to the outer transverse faces of the outer bracing timbers 43. A flooring 47 is nailed to the timbers 37, 39, 41, 43 and 45 on the top of the upper platform 35, the flooring 47 serving as the upper floor of the dwelling house. Two timbers 49 are located between and nailed at their ends to the opposing faces of an outer brace timber 43 and an inner brace timber 41, to provide a hatchway 51 on the upper platform 35. The flooring 47 about the hatchway is cut out to permit an access way between the lower and upper platforms 11, 35. ¾ inch plywood sheeting or any other suitable material may be used for flooring 47.

As shown in FIG. 5, the upper platform 35 has a smaller diameter than the lower platform 11, and is concentric with the lower platform 11. The upper platform 35 is mounted above the lower platform 35 is mounted above the lower platform 11 on 10 vertical legs or posts 53 located between the bottom of each of the 10 outer corners of the upper platform 35 and top flooring 29 of the lower platform 11. A center leg 55 is located between the center of the flooring 29 of the lower platform and the center of the bottom of the upper platform 35. Bearing blocks 57 are located between the upper end of the center leg 55 and the center of the bottom of the upper platform 35. The upper and lower ends of the vertical legs 53 and center leg 55 are nailed to the timber number numbers upon which they are resting and to the flooring 29 of the lower platform 11.

Three diagonal braces 59 are nailed between the upper sides or each vertical leg 53 and the two adjacent outer brace timbers 43 of the upper platform 35, and the adjacent main or radial timbers 37, 39, respectively. Four diagonal braces are nailed between the portions of the side of the center post 55 and the main timber 37 and two radial timbers 39.

As shown in FIGS. 2 and 4, the lower and upper platforms 11, 35 have polygon-like, substantially circular circumferences.

As shown in FIG. 5, the main wall of the dwelling includes a plurality of overlapping board-like members 63 forming an inside wall, nailed to a plurality of overlapping board-like members 65 forming an outside wall of the dwelling. A tension cable 67 such as a ⅜ inch galvanized steel guy wire or cable is clamped to the uppermost circumference of the outside wall members 65. The cable 67 is located as shown in FIG. 5. The spaces 69 formed between the inside and outside wall members 63, 65 may be filled with a suitable insulation material.

Also, as shown in FIG. 5, the inside and outside members 63, 65 of the main wall slope away from the lower platform 11, and are held upright by the retaining action of the tensioning cable 67. The bottom ends of the inside wall members or timbers 63 rest upon the flooring 29 of the lower platform 11, and are nailed into the flooring 29 and timbers 13, 15, 19, 21 located immediately below.

The outside wall members 65 are longer than the inside wall members 63 to permit the bottom ends of the outside wall members 65 to extend down to or below the level of the foundation formed by the outer, inner, and center solid footings 1, 5, 9. The lowermost portions of the outer transverse faces of the outside wall members 65 are nailed into the flooring 29.

As shown in FIG. 7, windows 69 can be provided in the main or lower wall 71 of the dwelling, by cutting window holes through the inside and outside wall members 63, 65. Of course, the windows 69 may be provided for prior assemblying the main wall 71, by cutting the inside and outside wall members 63, 65 to appropriate lengths beforehand, Wherever a window 69 is located, strengthening headers 73, 75 should be installed both above and below the window frame, as shown in FIG. 5. Ordinary window glass may be secured into the window holes 69.

One or more doorways may be installed as shown in FIG. 7. Wherever a doorway is located, strengthening headers 77, 79 should be installed as shown.

A section view of the upper wall 81 of the dwelling is shown in FIG. 5. The upper wall is assembled from overlapping boards or members 83, as shown in FIG. 8. The overlapping boards 83 are nailed at their ends to the outermost portions of the flooring 47 of the upper platform 35. The upper wall 81 slopes away from the upper platform 35. A second tension cable 85 of ⅜ inch galvanized steel guy wire or other suitable cable, is located as shown in FIG. 5 around the circumference of the uppermost portions of the upper wall 81, to retain its overlapping members or boards 83 in an upright position. The cable 85 is clamped to the upper wall 81.

Various types of roofs can be used. A conical roof 87 is shown in FIG. 7. The conical roof 87 is constructed by nailing tapered boards 89 (see FIG. 9) into an overlapping configuration as shown in the roof edge view of FIG. 10. The tapered boards 89 are so positioned to permit a circular skylight 91 to be formed at the top of the roof (see FIG. 7), and joined both together and to the top ends of the inside and outside members 63, 65 of the main wall and the top ends of the upper wall 81.

The circular skylight 91 is reinforced by a compression ring positioned as shown in FIG. 5. Tar paper 97 or similar material should be nailed to the top surface of the roof 87. Shingles such as cedar shingles 99 are nailed over the tar paper to complete the roof. Glass 95 can be cut to cover the skylight 91 and yet provide material light for the upper platform or floor 35.

Fibreglass batts 101 can be stapled onto the inside wall members 63 prior to installing the outside wall members 65 to provide insulation for the main wall 71. To insulate the roof 87, sheets of rigid foam (not shown) are secured to the ceiling of the dwelling or underside of the roof.

FIG. 11 shows a modification of the dwelling, wherein the upper wall 81 has been extended in height beyond the lower roof line 103. The construction of the extended upper wall 81 must be made similar to that of the main wall 71 of the dwelling, as previously described. In this manner, a clerestory concnetric dwelling is provided having an upper roof 104 and a lower roof 102.

The conical roof 87 of the dwelling, as previously described, can be constructed several ways including the use of a plurality of pairs of crossed poles forming a hyperbolic paraboloid of revolution.

A fourth alternative roof design, as shown in FIG. 12, is a folded plate 105 formed from a plurality of tapered boards. An advantage of the folded plate roof 105 design is that the windows 107 of the dwelling can easilly be incorporated as part of the folded plate roof 105, providing a circular ring of triangular windows 107, as shown. The folded plate roof 105 is ideally suited for the previously described clerestory version of the concentric dwelling.

Regardless of the roof design employed, the compression ring 93 should be included to keep the roof from settling inward.

A ladder or stepway (not shown) can be used to provide both an entry and exit means through the hatchway of the upper floor 35. Instead of providing a hatchway in the upper platform 35, a doorway or opening can be provided through a portion of the upper wall 81.

Although the concentric dwelling has been described with only one upper floor 35, concentric with a lower floor 11, the concentric dwelling is not so limited. The construction techniques disclosed can readily be applied to constructing concentric dwellings with three or more concentric floors or platforms.

While a preferred embodiment of this invention has been described in detail, many other embodiments may be recognized by those skilled in the art, without departing from the spirit and scope of the invention as described and claimed below.

What I claim is:

1. A concentric building comprising:

means for a foundation which includes a plurality of first solid footings arranged into an outer circle, a plurality of second solid footings arranged into an inner circle within and concentric with said outer circle of first footings, and a single solid footing located at the center of said concentric circles of first and second solid footings;

a substantially circular lower platform having a bottom resting upon said foundation means, and a top serving as a lower floor of said building;

a lower wall having a bottom portion rigidly attached to the outer circumference of said lower platform, said lower wall sloping outwardly away from said lower platform;

a first tensioning means secured around the uppermost outer surface of said lower wall, for retaining said lower wall in an upright position;

at least one substantially circular upper platform serving as an upper floor of said building, said upper platform having a top and bottom, and being smaller in diameter than the diameter of said lower platform;

means for rigidly holding said upper platform concentric with and a distance above said lower platform;

at least one upper wall having a bottom portion rigidly attached to the outer circumference of the top of said upper platform, said upper wall sloping outwardly away from said upper platform;

a second tensioning means secured around the uppermost outer surface of said upper wall, for retaining said upper wall in an upright position;

a door hingedly mounted within a doorway out through said lower wall;

means for providing a roof rigidly connected to the top edges of said lower and upper walls; and means for providing an entranceway between siad upper and lower platforms.

2. The concentric building of claim 1, wherein said first tensioning means is a galvanized steel cable.

3. The concentric building of claim 1, wherein said second tensioning means is a galvanized steel cable.

4. The concentric building of claim 1, wherein said means for rigidly holding said upper platform concentric with and a distance above said lower platform includes:

a plurality of posts, all but one of said posts being evenly spaced around the outermost surface of the bottom of said upper platform, a single one of said posts being located at the center of the bottom of said upper platform, said posts being vertically aligned with one end rigidly attached and braced to the bottom of said upper platform, the other ends of said posts being rigidly connected to the top of said lower platform.

5. The cencentric building of claim 1, wherein said roof means includes:

a plurality of overlapping tapered boards rigidly connected to form a conical roof;

tar paper covering the top of said plurality of tapered boards; and a plurality of cedar shakes overlaying said tar paper and nailed to said plurality of tapered boards.

6. The concentric building of claim 1, wherein said roof means includes:

a plurality of tongue and grooved tapered boards interconnected to form a conical roof;

tar paper covering the top of said interconnected plurality of tapered boards; and a plurality of cedar shakes overlaying said tar paper and nailed to said plurality of tapered boards.

7. The concentric building of claim 1, wherein said roof means includes:

a plurality of tapered boards;

said plurality of tapered boards being interconnected along their longitudinal edges to form a folded plate roof.

8. The concentric building of claim 1, wherein said upper wall is extended in height to provide a clerestory concentric building.

9. The concentric building of claim 1, wherein said means for providing an entranceway between said upper and lower platforms includes a hatchway cut through a section of said upper platform.

10. The concentric building of claim 1, wherein said roof means is truncated to provide a skylight.

11. The concentric building of claim 11, wherein said roof means further includes a compression ring connected to said roof means around the area of said skylight.

12. The concentric building of claim 5, wherein said lower wall further includes a plurality of spaced apart windows.

13. The concentric building of claim 6, wherein said lower wall further includes a plurality of spaced apart windows.

14. The concentric building of claim 7, wherein said folded plate roof further includes a plurality of triangular window glasses, each one of said plurality of window glasses being inserted in an individual one of a plurality of triangular spaces formed between the top edge of said lower wall and adjacent portions of said folded plate roof.

15. The concentric building of claim 1, wherein said lower wall further includes:

a plurality of first boards vertically oriented and overlappingly joined to form an inner wall; and a plurality of second boards vertically oriented and overlappingly joined to form an outer wall.

16. The concentric building of claim 15, which further includes insulation means inserted between said inner and outer walls of said lower walls.

17. The concentric building of claim 1, wherein said upper wall further includes:

a plurality of boards vertically oriented and overlappingly joined to form said upper wall.

18. The concentric building of claim 11, wherein a tempered glass plate is secured in a water tight manner to a top edge of the circumference of said truncated roof means and compressing ring.

19. The concentric building of claim 1, wherein said roof means has an underside serving as a ceiling for said building; and a plurality of sheets of rigid foam are secured to said ceiling to provide insulation.

20. The concentric building of claim 16, wherein said insulation means are fibre glass batts.

* * * * *